United States Patent [19]

Kropkowski et al.

[11] Patent Number: 4,921,249

[45] Date of Patent: May 1, 1990

[54] BOARDGAME COMBINING TWO LEVELS OF PLAY

[75] Inventors: James Kropkowski, Rutherford, N.J.; Jesse L. Colodner, Pearl River, N.Y.

[73] Assignee: James M. Kropkowski, Rutherford, N.J.

[21] Appl. No.: 261,411

[22] Filed: Oct. 24, 1988

[51] Int. Cl.[5] ..... A63F 3/00

[52] U.S. Cl. ..... 273/256; 273/274

[58] Field of Search ..... 273/242, 243, 249, 256, 273/273, 274, 283, 284

[56] References Cited

U.S. PATENT DOCUMENTS

| | | | |
|---|---|---|---|
| 164,654 | 6/1875 | Moulton | 273/284 |
| 1,349,587 | 8/1920 | Smith et al. | 273/284 X |
| 1,490,153 | 4/1924 | Wischhusen et al. | 273/249 |
| 3,779,555 | 12/1973 | Wimberly | 273/249 |
| 3,889,954 | 6/1975 | Malisow | 273/256 |
| 4,089,527 | 5/1978 | Roth | 273/249 |
| 4,346,900 | 8/1982 | Lamlee | 273/274 |
| 4,746,126 | 5/1988 | Angileri | 273/274 X |

*Primary Examiner*—Edward M. Coven
*Assistant Examiner*—William E. Stoll
*Attorney, Agent, or Firm*—Iman Abdallah

[57] ABSTRACT

A board game is disclosed which includes an octagonal-shaped playing board having a plurality of marked spaces along the periphery of the board and a plurality of casino games disposed in the central portion of the board. The plurality of marked spaces define a path of progression during play and include written or graphic indicia corresponding to selective options and directives for the players. The marked spaces having indicia corresponding to selective options either permit a player to purchase and develop "casinos," or "parking lots,", or to purchase and sell "parking lot supplies," "casino games," or "boardwalk supplies." Marked spaces having indicia corresponding to selective directives either permit a player to collect or require a player to pay token money to another player or the "Bank." Players wager token money at the centrally-disposed casino games when that player's playing piece lands on a casino space. Movement of the playing pieces is by chance, viz. a throw of dice.

6 Claims, 3 Drawing Sheets

BOARDGAME COMBINING TWO LEVELS OF PLAY

BACKGROUND OF THE INVENTION

The present invention generally relates to new and useful improvements in boardgames and boardgame apparatus. More particularly this invention relates to boardgames involving chance moves along a path of progression and property transactions.

Boardgames in the prior art in which playing pieces are moved along a path of progression in accordance with chance moves have been known from antiquity. Various boardgames involving financial and property transactions have also been developed in the prior art. However, no boardgame known to the Applicant is revealed in the prior art wherein secondary game playing is integrated into the primary game objective, combining games of chance on two levels of play, the primary game of chance determining the gain to a player from the secondary games.

SUMMARY OF THE INVENTION

An object of the present invention is to provide a novel boardgame apparatus.

Another object of this invention is to provide a boardgame combining casino-type games of chance and a game of chance progression along a path.

A still further object of this invention is to provide a boardgame wherein a primary game of chance progression along a path determines the gain to a player from secondary casino-type games of chance.

These and other objects of the present invention will be more apparent to those skilled in the art from the following drawings, specifications and claims.

DESCRIPTION OF THE PREFERRED EMBODIMENT

Figure 1:
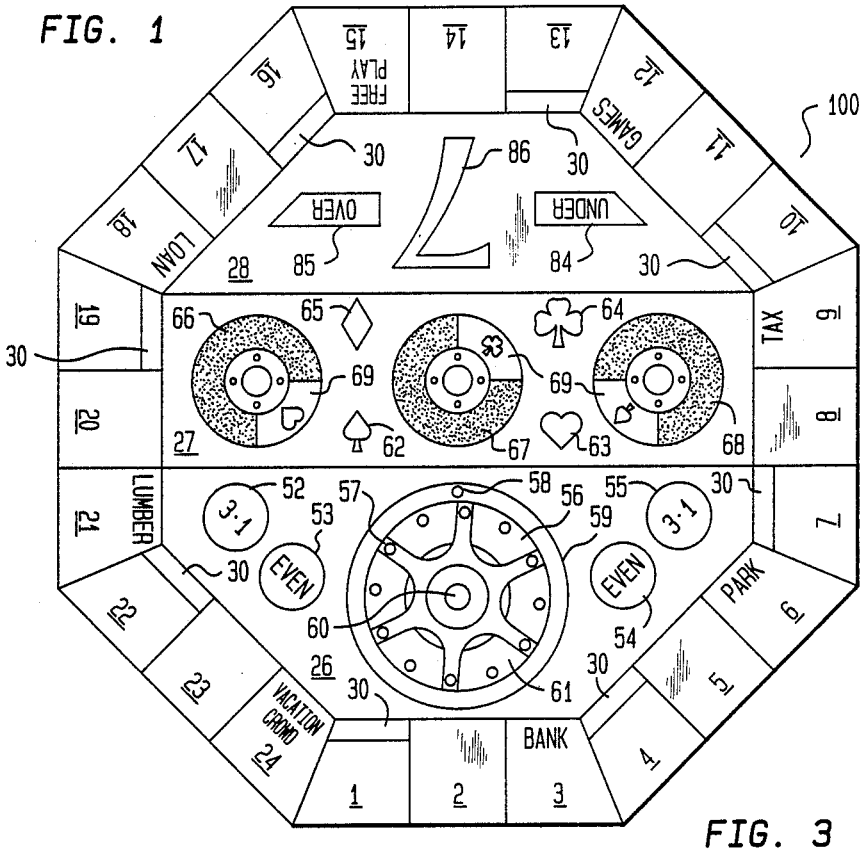
FIG. 1 is a top plan view of a preferred embodiment of the playing board of the present invention.

FIG. 1 is a top plan view of the playing board 100 of the present invention, illustrating the plurality of marked playing spaces 1–24 disposed along the periphery of playing board 100 and the casino games 26, 27, 28 disposed in the central portion of playing board 100. The preferred embodiment of playing board 100 is formed in an octagonal shape having three of the marked playing spaces 1–24, for example, the spaces numbered 4, 5, 6, within each octant. Playing board 100 is a folding board of substantial thickness.

Marked playing spaces that are numbered 1, 4, 7, 10, 13, 16, 19 and 22 include indicia means comprising a solid strip 30 in a plurality of different colors extending horizontally across the top portion of said spaces 1, 4, 7, 10, 13, 16, 19 and 22 to indicate opportunity to purchase and develop "parking lots," and/or to collect token money in accordance with the rules of the game for purpose of gain to a player. Marked playing spaces that are numbered 2, 5, 8, 11, 14, 17, 20 and 23 include indicia means comprising a solid playing space in a plurality of different colors. Such indicia means indicate opportunity to purchase and develop "casinos" and/or to collect token money in accordance with the rules of the game for purpose of gain to a player. In the preferred embodiment of the playing board 100, the parking lot spaces 1, 4, 7, 10, 13, 16, 19 and 22 are respectively disposed adjacently to the left of casino spaces 2, 5, 8, 11, 14, 17, 20 and 23. Adjacent parking lot spaces and casino spaces within each octant, for example parking lot space 1 and casino space 2, are color coordinated, thereby providing eight varied-colored parking lot and casino combinations. The rightmost space within each octant constitutes specialty spaces 3, 6, 9, 12, 15, 18, 21 and 24, each having a distinctive indicia means thereon indicating varied opportunities and directions in accordance with the rules of the game for purpose of gain to a player. BANK space 3 directs payment of token money to a player; PARK space 6 indicates opportunity to purchase and/or sell parking lot supplies; TAX space 9 directs payment of token money; GAMES space 12 indicates opportunity to purchase and/or sell casino games; FREE PLAY space 15 entitles a player to move his playing piece to any of the marked spaces on the playing board 100; LOAN space 18 indicates opportunity to purchase rights to lend token money to other players; LUMBER space 21 indicates opportunity to purchase and/or sell boardwalk supplies; and VACATION CROWD space 24 directs payment of token money from the bank in relation to the properties owned by a player.

Casino games 26, 27, 28 disposed in the central portion of playing board 100 include BIG WHEEL 26, SLOT WHEELS 27 and LUCKY SEVEN 28. Casino games 26, 27, 28 are explained in greater detail hereinafter.

Figure 2:
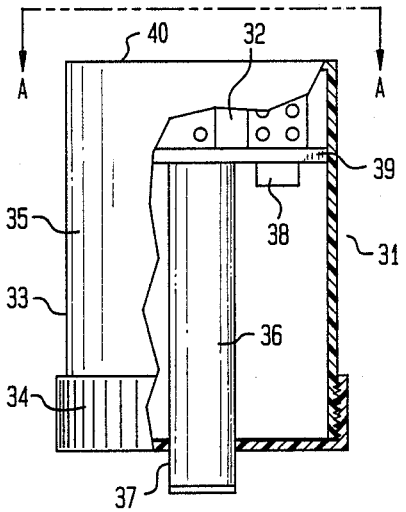
FIG. 2 is a fragmented side elevational view of the dice shaker of the present invention.
Figure 3:
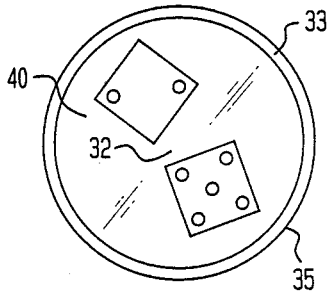
FIG. 3 is a top plan view taken along line A—A of FIG. 2.

The board game apparatus of the present invention further includes chance means 31 comprising a pair of dice 32 and dice shaker 33. Dice shaker 33 is shown in FIG. 2 in a fragmented side elevational view and in FIG. 3, a top plan view taken along line A—A of FIG. 2. Dice shaker cap 34 is threadedly attached to the bottom portion of dice shaker cylinder 35. A weighted stem 36 extends through an opening 37 formed in shaker cap 34, being slidably associated therewith. A plurality of weights 38 are attached to stem base 39. Dice 32 are disposed between the top wall of stem base 39 and the top wall 40 of dice shaker cylinder 35. Top wall 40 of dice shaker cylinder 35 is transparent to permit viewing of dice 32.

Figure 4:
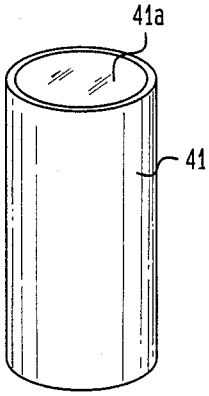
FIG. 4 is a perspective view of a playing piece.
Figure 5:
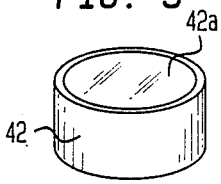
FIG. 5 is a perspective view of a bid chip.

FIG. 4 illustrates the playing piece 41 used by each player during the game. Playing piece 41 is provided with playing piece top 41a in a plurality of different colors corresponding to the plurality of different colors for parking lots 1, 4, 7, 10, 13, 16, 19, 22 and casinos 2, 5, 8, 11, 14, 17, 20, 23. Thus in the preferred embodiment eight different colors are utilized. Furthermore, four color coordinated bid chips, a single bid chip 42 with color coordinated bid chip top 42a being shown in FIG. 5, are provided for each playing piece 41 for use in accordance with the rules of the game.

Figure 6:
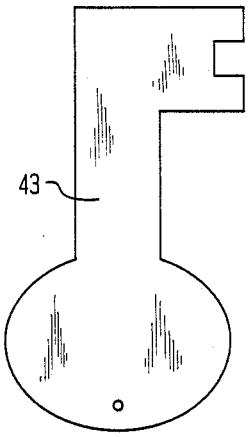
FIG. 6 is a plan view of a proof of purchase key.
Figure 7:
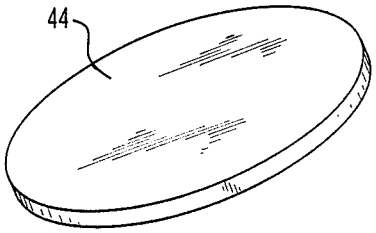
FIG. 7 is a plan view of a proof of purchase disc.

Color-coordinated proof of purchase keys, a single key 43 being shown in FIG. 6, and color-coordinated proof of purchase discs, a single disc 44 being shown in FIG. 7, are also provided corresponding respectively to the plurality of casinos 2, 5, 8, 11, 14, 17, 20, 23 and the plurality of parking lots 1, 4, 7, 10, 13, 16, 19, 22.

Figure 8:
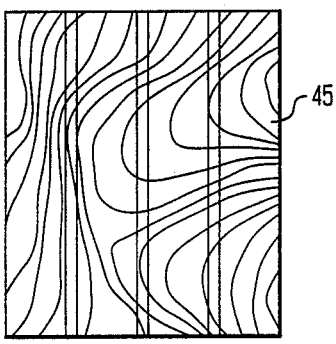
FIG. 8 is a plan view of a boardwalk supply.
Figure 10:
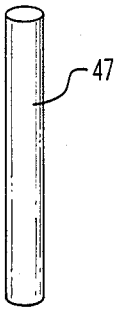
FIG. 10 is a perspective view of a parking lot peg.
Figure 9:
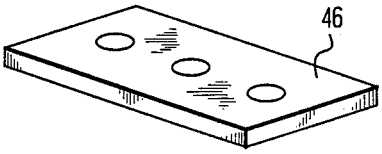
FIG. 9 is a perspective view of a parking lot peg holder.
Figure 11:
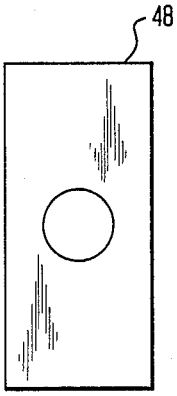
FIG. 11 is a plan view of a first casino game marker.
Figure 12:
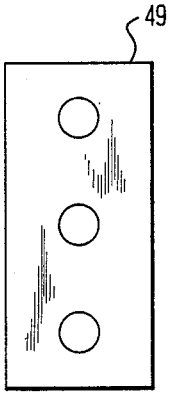
FIG. 12 is a plan view of a second casino game marker.
Figure 13:
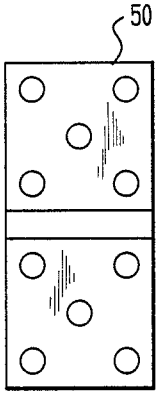
FIG. 13 is a plan view of a third casino game marker.
Figure 14:
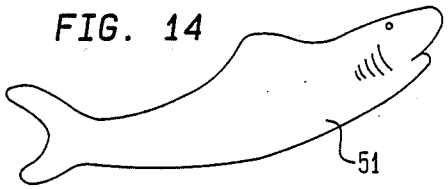
FIG. 14 is a plan view of the shank token.
Figure 15:
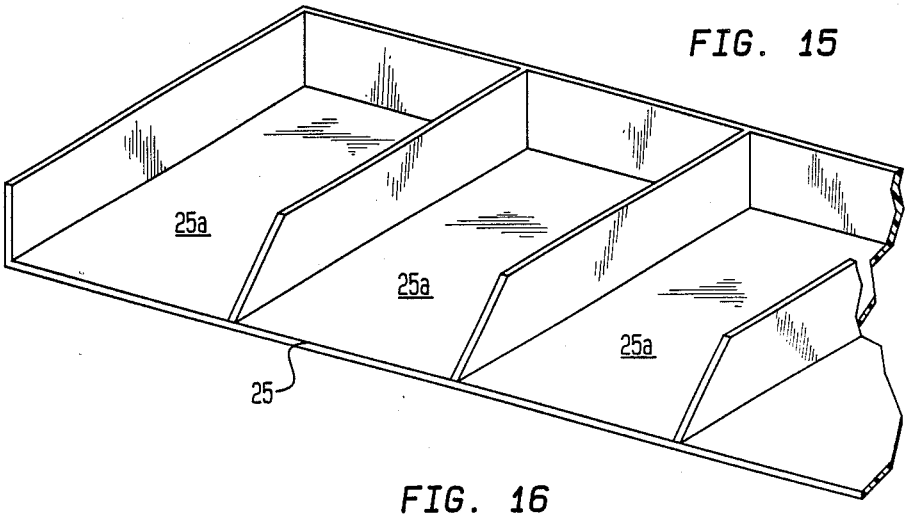
FIG. 15 is a fragmented perspective view of the bank.

Board game apparatus further includes a plurality of boardwalks, a single boardwalk 45 being shown in FIG. 8, and a plurality of parking lot peg holders and parking lot pegs, a single peg holder 46 and peg 47 being respectively shown in FIGS. 9 and 10. Casino game markers 48, 49, 50 are illustrated in FIGS. 11, 12, 13, respectively corresponding to casino games 26, 27, 28, i.e. casino game marker 48 corresponds to BIG WHEEL 26, casino game marker 49 corresponds to SLOT WHEELS 27, and casine game marker 50 corresponds to LUCKY SEVEN 28 (FIG. 1). FIG. 14 illustrates the shark token 51 whose possession indicates the right to lend money in accordance with the rules of the game. Board game apparatus also includes bank 25, a fragmented perspective view being shown in FIG. 15 illustrating the plurality of compartments **25*a*** for receipt of token money of various denominations.

The significance of the various components of the board game apparatus described heretofore will become more apparent in reference to the rules of play as detailed below. Prior to describing the rules of the game, however, casino games 26, 27, 28 will be presented in greater detail.

CASINO GAMES

Referring to the preferred embodiment of playing board 100 shown in FIG. 1, board game apparatus is seen to include three casino games 26, 27, 28 disposed in the central portion of playing board 100: BIG WHEEL 26, SLOT WHEELS 27 and LUCKY SEVEN 28. The odds in the casino games 26, 27, 28 all favor the casino owner.

BIG WHEEL

BIG WHEEL 26 includes four odds spaces 52, 53, 54, 55, there being two even odds spaces 53, 54, a three-to-one odds space 52, and a two-to-one odds space 55. Rotatably mounted wheel 56 has a plurality of upwardly extending tabs 57 disposed along the periphery of wheel 56. Flexible wheel space marker 58 is mounted to wheel frame 59, tabs 57 interacting with wheel space marker 58 when wheel 56 is spun about its axis by rotation of wheel knob 60. Wheel 56 includes a plurality of odds space indicia 61 formed on its face which correspond to various ones of the odds spaces 52, 53, 54, 55.

To play BIG WHEEL 26 a player makes a wager of any amount and places a bid chip 42 on the corresponding odds space 52, 53, 54, 55. The player then spins wheel 56 by rotating wheel knob 60, and either loses or collects based on the wager. The casino owner collects the loss or pays the winnings. If the amount due on the wager cannot be paid in token money, restitution must be made in some other way (sale of property, loan, etc.).

SLOT WHEELS

Figure 16:
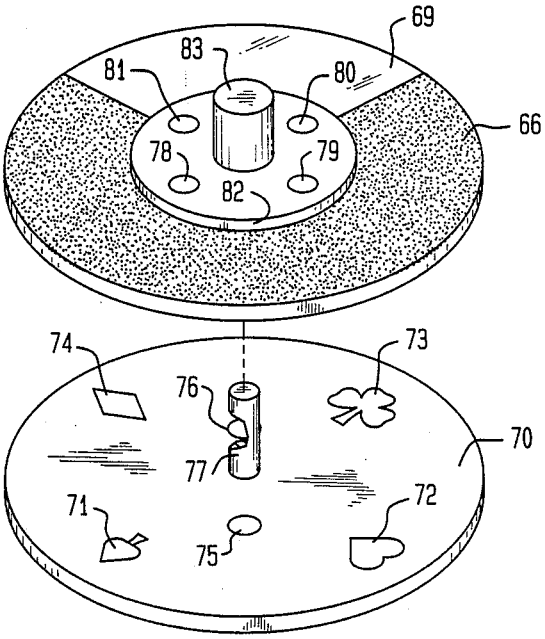
FIG. 16 is an exploded perspective view of a second casino game wheel and wheel base.

SLOT WHEELS 27 includes four suit spaces 62, 63, 64, 65 corresponding to the four suits in a deck of regular playing cards, i.e. spade 62, heart 63, club 64 and diamond 65. SLOT WHEELS 27 further includes three rotatably mounted wheels 66, 67, 68, each having a transparent window 69 to permit viewing of wheel base 70 (FIG. 16) disposed below wheels 66, 67, 68. FIG. 16 illustrates in an exploded perspective view the relationship of wheel base 70 and wheel 66 which is typical of wheels 67, 68. Wheel base 70 has disposed on its face wheel base indicia 71, 72, 73, 74 for the four suits. Base magnets 75, 76 are disposed toward wheel post 77 from suit indicia 71, 72, 73, 74. Wheel 66 includes four wheel magnets 78, 79, 80, 81 which extend through wheel magnet base 82 and wheel 66 for magnetic cooperation with base magnets 75, 76. When wheel 66 is spun by rotating wheel knob 83, window 69 is caused to selectively reveal one of the base indicia 71, 72, 73, 74 by the magnetic attraction of wheel magnets 78, 79, 80, 81 and base magnets 75, 76.

To play SLOT WHEELS 27 a player makes a wager in any amount and places a bid chip 42 on the corresponding suit spaces 62, 63, 64, 65. The player then spins all three wheels 66, 67, 68 and either loses or collects based on the wager. The casino owner collects the loss or pays the winnings. One matching indicia 71, 72, 73, 74 on either of the outside wheels 66, 68 pays even token money on a wager; two matching indicia 71, 72, 73, 74 on either the two outside wheels 66, 68 or the center wheel 67 and an outside wheel 66 or 68 pays two-to-one odds on the amount wagered; three matching indicia 71, 72, 73, 74 pays three-to-one odds on the amount wagered. No payment is made if the only matching indicia 71, 72, 73, 74 is on the center wheel 67. If the amount due on the wager cannot be paid in token money, restitution must be made in some other way (sale of property, loan, etc.).

LUCKY SEVEN

LUCKY SEVEN 28 includes an under space 84, an over space 85 and a seven space 86. To play LUCKY SEVEN 28 a player makes a wager of any amount and places a bid chip 42 on the corresponding space 84, 85, 86. The player then shakes the dice shaker 33 and reads the number of spots on the face of dice 32 showing through the top wall 40 of shaker cylinder 35. A match of the dice 32 and the over space 85 or the under space 84 (over or under seven) pays an equal amount to the amount wagered. A match of the dice 32 and the seven space 86 (seven on dice) pays three-to-one odds on the amount wagered. The casino owner collects the loss or pays the winnings. If the amount due on the wager cannot be paid in token money, restitution must be made in some other way (sale of property, load, etc.).

RULES OF THE GAME

Basic Rules

Two to eight players may play. Players move their playing piece 41 on each turn along the plurality of marked spaces 1–24 of playing board 100 for the number of spaces on the face of dice 32 as displayed through transparent top wall 40 of dice shaker cylinder 35.

Each player starts at the BANK space 3 and moves the playing piece 41 in a clockwise direction in accordance with chance means 31. Each player receives $700.00 in token money to start. To determine which player will be the first to move, one die is rolled, the player with the highest number on the face of the die moving first, the player with the second highest number moving next, etc.

Objective of The Game

The object of the game is to purchase, develop and operate properties, collecting and paying token money in accordance with the rules of the game. The winning is the last remaining player in the game or the player with the largest amount of token money at the end of play.

Purchasing Property

All of the spaces 1–24 on the playing board 100 may be purchased except the BANK space 3, TAX space 9, FREE PLAY space 15 and VACATION CROWD space 24 for the amounts shown in the schedule below.

| SCHEDULE OF PURCHASE PRICES | |
|---|---|
| CASINOS | $200.00 |
| PARKING LOTS | $100.00 |
| LUMBER SUPPLY CO. | $300.00 |
| Boardwalks | $50.00 each |
| GAME SUPPLY CO. | $300.00 |
| Individual Games | $50.00 each |
| PARKING LOT SUPPLY CO. | $200.00 |
| Parking spaces | $25.00 each |
| LOAN | $200.00 |

When the playing piece 41 of a player lands on a parking lot space 1, 4, 7, 10, 13, 16, 19, 22, LUMBER space 21, GAMES space 12, PARK space 6, or LOAN space 18, the rights to collect and duty to pay token money in accordance with the rules of the game may be purchased by that player in accordance with the Schedule of Purchase Prices. The amount of purchase is given to the bank 25 and the purchasing player receives one of the plurality of proof of purchase discs 44 to indicate ownership of the corresponding parking lot 1, 4, 7, 10, 13, 16, 19, 22, or the plurality of boardwalks 45, parking lot peg holders 46 and parking lot pegs 47, or casino game markers 48, 49, 50 to respectively indicate ownership of the LUMBER supply company, the PARK supply company, or the GAMES supply company. When the LOAN space 18 is purchased, the purchasing player receives, in exchange for token money to the bank 25, the shark token 51.

To purchase a casino, a player whose playing piece 41 lands on a casino space 2, 5, 8, 11, 14, 17, 20, 23 must first place a bid chip 42 on that space to show interest. The purchase can be made only on the second time that a player's playing piece 41 lands on that casino space 2, 5, 8, 11, 14, 17, 20, 23. A player is not obliged to purchase and may wait for a future landing. Bid chip 42 remains on the casino space 2, 5, 8, 11, 14, 17, 20, 23 until the space is purchased. When purchased, the purchasing player receives from the bank 25, in exchange for token money, the corresponding proof of purchase key 43 to indicate ownership of the corresponding casino space 2, 5, 8, 11, 14, 17, 20, 23.

Developing Property

Once a player owns a casino space 2, 5, 8, 11, 14, 17, 20, 23 that property can be developed by making purchases from the LUMBER supply company and GAMES supply company. Boardwalks 45 can be purchased when the playing piece 41 lands on the casino space 2, 5, 8, 11, 14, 17, 20, 23 which that player owns, or when the player's playing piece 41 lands on the LUMBER space 21. A maximum of three boardwalks 45 can be purchased for each casino space 2, 5, 8, 11, 14, 17, 20, 23. When a player's playing piece 41 lands on a casino space 2, 5, 8, 11, 14, 17, 20, 23 owned by that player, boardwalks 45 can be purchased for only that casino space 2, 5, 8, 11, 14, 17, 20, 23. Therefore, if a playing piece 41 lands on a casino space 2, 5, 8, 11, 14, 17, 20, 23 that already has three boardwalks 45, no additional boardwalks 45 may be purchased. When a playing piece 41 lands on the LUMBER space 21, boardwalks 45 can be purchased for any casino space 2, 5, 8, 11, 14, 17, 20, 23 owned by that player.

Boardwalks 45 create new landing spaces when placed on a casino space 2, 5, 8, 11, 14, 17, 20, 23. When one boardwalk 45 is purchased and placed, casino space 2, 5, 8, 11, 14, 17, 20, 23 has two landing spaces; when two or three boardwalks 45 are purchased and placed, casino space 2, 5, 8, 11, 14, 17, 20, 23 has three landing spaces. When the playing piece 41 of an opposing player lands on a boardwalk 45, that player is obliged to play at all casino games 26, 27, 28 at that casino space 2, 5, 8, 11, 14, 17, 20, 23. When the playing piece 41 lands on the open casino space 2, 5, 8, 11, 14, 17, 20, 23, playing of casino games 26, 27, 28 is at the option of the landing player.

Casino game markers 48, 49, 50 can be purchased when the playing piece 41 lands on the casino space which that player owns, or when the player's playing piece 41 lands on the GAMES space 12. A maximum of three casino game markers 48, 49, 50 (one to represent each game) can be purchased for each casino space 2, 5, 8, 11, 14, 17, 20, 23. When a player's playing piece 41 lands on a casino space 2, 5, 8, 11, 14, 17, 20, 23 owned by that player, game markers 48, 49, 50 can be purchased for only that casino space 2, 5, 8, 11, 14, 17, 20, 23. Therefore, if a playing piece 41 lands on a casino space 2, 5, 8, 11, 14, 17, 20, 23 that already has three game markers 48, 49, 50, no additional game markers 48, 49, 50 may be purchased. When a playing piece 41 lands on the GAMES space 12, casino game markers 48, 49, 50 can be purchased for any casino space 2, 5, 8, 11, 14, 17, 20, 23 owned by that player.

The owner of a parking lot space 1, 4, 7, 10, 13, 16, 19, 22 receives a parking fee in the amount of $10.00 in token money each time an opposing player lands their playing piece 41 on that space. Once a player owns a parking lot space 1, 4, 7, 10, 13, 16, 19, 22 that property can be developed by making purchases from the PARK supply company. Pegs 47 can be purchased to indicate additional parking spaces when the playing piece 41 lands on the parking lot space which that player owns, or when the player's playing piece 41 lands on the PARK space 6. A maximum of three parking lot pegs 47 can be purchased for each parking lot space 1, 4, 7, 10, 13, 16, 19, 22. When a player's playing piece 41 lands on a parking lot space 1, 4, 7, 10, 13, 16, 19, 22, owned by that player, pegs 47 can be purchased for only that parking lot space 1, 4, 7, 10, 13, 16, 19, 22. Therefore, if a playing piece 41 lands on a parking lot space 1, 4, 7, 10, 13, 16, 19, 22 that already has three parking lot pegs 47, no additional pegs 47 may be purchased. When a playing piece 41 lands on the PARK space 12, pegs 47 can be purchased for any parking lot space 1, 4, 7, 10, 13, 14, 19, 22 owned by that player. An opposing player whose playing piece 41 lands on a parking lot space 1, 4, 7, 10, 13, 16, 19, 22 must pay to the owner of the parking lot the parking fee in the amount of $10.00 in token money plus $10.00 for each peg 47 on that parking lot space 1, 4, 7, 10, 13, 16, 19, 22.

The player that owns the LUMBER supply company, the GAMES supply company and/or PARK supply company is entitled to one free boardwalk 45, casino game marker 48, 49, 50 or peg 47 when his playing piece 41 lands on a casino space 2, 5, 8, 11, 14, 17, 20, 23, parking lot space 1, 4, 7, 10, 13, 16, 19, 22, LUMBER space 21, GAMES space 12 or PARK space 6 owned by that player. Additional boardwalks 45, casino game markers 48, 59, 50 and pegs 47 may be purchased in accordance with the Schedule of Purchase Prices. Token money paid for additional purchases is given to bank 25.

BANK

Each time a player passes BANK space 3, that player receives from bank 25 $25.00 for each property owned (casinos and parking lots) up to a $100.00 maximum.

TAX

A player that lands on TAX space 9 must pay to bank 25 $25.00 for each property owned (casinos and parking lots).

FREE PLAY

A player that lands on FREE PLAY space 15 may move his playing piece 41 to any of the marked spaces 1–24 of the playing board 100. If a player moves his playing piece 41 to BANK space 3, that player receives payment from bank 25 in accordance with the rules of the game, but may not pass BANK space 3 and receive payment when moving from FREE PLAY space 15.

VACATION CROWD

A player that lands on VACATION CROWD space 24 receives additional token money in either of two ways: (1) ten times the number shown on a roll of dice 32, paid from bank 25, or (2) the amount of any winning wager in any or all casino games 26, 27, 28. All wagered losses are paid to bank 25; all wagered winnings are paid from bank 25.

Loansharking

LOAN space 18 remains the property of the bank 25 until purchased by a player. When purchased, the player receives shark token 51 and all rights to loansharking. A loan may be made in any amount to any player upon request. When a player makes a loan, that player places a bid chip 42 on LOAN space 18 as a reminder. The owner of LOAN space 18 collects interest on the loan each time the indepted player passes LOAN space 18. The amount of interest is determined by the roll of one die and is equal to ten times the number of spots of the face of the die. If an indebted player lands on LOAN space 18, the loan principal and interest must be paid. All interest money is kept by the owner of LOAN space 18. The loan principal is returned to bank 25. The owner of LOAN space 18 may also take a loan, but no interest is payable. If the owner of LOAN space 18 lands on that space, the loan principal must be paid to bank 25. If a player is unable to pay the loan principal or interest when due, property may be given in lieu of token money if mutually agreed. When property is given in lieu of token money for loan principal, the owner of LOAN space 18 must pay the amount of loan principal due to bank 25 in token money. If property offered is insufficient, the indebted player must leave the game and the owner of LOAN space 18 must pay the amount of loan principal to bank 25 in token money. Bank 25 cannot mortgage property, however, property may be re-sold to the LUMBER supply company, GAMES supply company or PARK supply company, if mutually agreed.

While this invention has been described with special emphasis upon a single preferred embodiment, it should be understood that within the scope of the appended claims, the invention may be practiced otherwise than is specifically described herein.

Therefore, what is claimed is:

1. A boardgame apparatus comprising a playing board including a plurality of marked spaces disposed along the periphery of said playing board, said marked spaces being interconnected in a path of progression around said playing board, said playing board further including one or a plurality of casino games disposed in the central portion of said playing board;

a plurality of playing pieces for movement by each player along said path of progression in accordance with the rules of the game;

indicia means on first selected ones of said marked spaces to indicate opportunity to purchase, develop casinos and/or collect token money in accordance with the rules of the game for purpose of gain to a player;

indicia means on second selected ones of said marked spaces to indicate opportunity to purchase, develop parking lots and/or collect token money in accordance with the rules of the game for purpose of gain to a player;

indicia means on a selected one of said marked spaces directing payment of token money to the player when that player's playing piece passes such marked space in accordance with the rules of the game;

indicia means on a second selected one of said marked spaces to indicate opportunity to purchase and/or sell parking lot supplies in accordance with the rules of the game for purpose of gain to a player;

indicia means on a third selected one of said marked spaces directing payment of token money by the player when that player's playing piece occupies such marked space in accordance with the rules of the game;

indicia means on a fourth selected one of said marked spaces to indicate opportunity to purchase and/or sell casino games in accordance with the rules of the game for purchase of gain to a player;

indicia means on a fifth selected one of said marked spaces entitling a player to move his playing piece to any of said marked spaces on the board when that player's playing piece occupies such marked space;

indicia means on a sixth selected one of said marked spaces to indicate opportunity to purchase rights to lend money to other players and receive interest payments in accordance with the rules of the game;

indicia means on a seventh selected one of said marked spaces to indicate opportunity to purchase and/or sell boardwalk supplies in accordance with the rules of the game for purpose of gain to a player;

indicia means on an eighth selected one of said marked spaces directing payment of token money to the player when that player's playing piece occupies such marked space;

chance means for directing movement of said playing pieces;

token money in various denominations;

a bank including compartments for receipt of token money in various denominations;

a plurality of parking lot supplies;

a plurality of boardwalk supplies;

a pluraity of casino game markers;

a plurality of bid chips color coordinated with each playing piece;

a plurality of proof of purchase keys coordinated with said first selected ones of said marked spaces;

a plurality of proof of purchase discs coordinated with said second selected ones of said marked spaces; and a shark token indicating possession of rights to lend money.

2. A boardgame apparatus as described in claim 1 wherein said plurality of casino games includes BIG WHEEL, SLOT WHEELS, and LUCKY SEVEN.

3. A boardgame comprising:

an octagonal-shaped playing board having a plurality of marked spaces disposed on the surface of said playing board along its periphery and one or a plurality of games of chance disposed in the central portion of said playing board, said marked spaces defining a path of progression around the playing board, said marked spaces including graphic and/or written indicia means corresponding to selective options and directives for a player;

chance means for directing movement of said players;

token money in various denominations;

a plurality of playing pieces, each playing piece being of a different color for each player;

a plurality of bid chips color coordinated with each playing piece;

a plurality of various markers to indicate different options and directives for a player;

wherein each player receives a sum of token money at the start of the game and the chance means are utilized in turn to determine the number of spaces that each player's playing piece is moved within the marked spaces of the playing board, selective first marked spaces are purchased at a player's option by payment of token money in return for a first one of the various markers when a playing piece of that player lands on that first marked space, said first marker being placed on that marked space to indicate rights of the purchasing player to collect and duty to pay token money in accordance with the rules of the game, selective second marked spaces are purchased at a player's option by payment of token money in return for a second one of the various markers when a playing piece of that player lands on that second marked space two times and the first time that the playing piece landed on said second marked space the player had placed a bid chip on that marked space to indicate interest in purchasing that second marked space, said second marker being held by that player to indicate rights of the purchasing player to purchase, develop and sell in accordance with the rules of the game, selective third marked spaces indicating rights and duties of a player that lands a playing piece on that third marked space to pay or receive token money in accordance with the rules of the game, said games of chance being compulsorily played each time the playing piece of an opposing player lands on a second marked space owned by a player and optionally played each time the playing piece of a player lands on a second marked space not owned by any player.

4. A boardgame as described in claim 3 wherein said games of chance include BIG WHEEL, SLOT WHEELS, and LUCKY SEVEN.

5. A boardgame as described in claim 3 wherein said chance means comprises a pair of dice.

6. A boradgame comprising:

an octagonal-shaped playing board having a plurality of marked spaces disposed on the surface of said playing board along its periphery and one or a plurality of games of chance disposed in the central portion of said playing board, said marked spaces defining a path of progression around the playing board, said games of chance including BIG WHEEL, SLOT WHEELS, and LUCKY SEVEN, said marked spaces including graphic and/or written indicia means corresponding to selective options and directives for a player;

chance means for directing movement of said players, said chance means comprising a pair of dice.

token money in various denominations;

a plurality of playing pieces, each playing piece being of a different color for each player;

a plurality of bid chips color coordinated with each playing piece;

a plurality of various markers to indicate different options and directives for a player;

wherein each player receives a sum of token money at the start of the game and the dice are tossed in turn to determine the number of spaces that each player's playing piece is to be moved within the marked spaces of the playing board, the number of spaces moved corresponding to the number showing on the top faces of the pair of dice, selective first marked spaces are puchased at a player's option by payment of token money in return for a first one of the various markers when a playing piece of that player lands on that first marked space, said first marker being placed on that marked space to indicate rights of that player to collect and duty to pay token money in accordance with the rules of the game, selective second marked spaces are purchased at a player's option by payment of token money in return for a second one of the various markers when a playing piece of that player lands on that second marked space two times and the first time that the playing piece landed on that second marked space the player had placed a bid chip on that marked space to indicate interest in purchasing that second marked space, said second marker being held by that player to indicate rights of that player to purchase, develop and sell in accordance with the rules of the game, selective third marked spaces indicating rights and duties of a player that lands a playing piece on that third marked space to pay or receive token money in accordance with the rules of the game, said games of chance being compulsorily played each time the playing piece of an opposing player lands on a second marked space owned by a player and optionally played each time the playing piece of a player lands on a second marked space not owned by any player.

* * * * *